US009192936B2

(12) United States Patent
Schaefer

(10) Patent No.: US 9,192,936 B2
(45) Date of Patent: Nov. 24, 2015

(54) METHOD AND DEVICE FOR CRUSHING AND DRYING MOISTURE-CONTAINING MATERIAL, ESPECIALLY WOOD

(75) Inventor: Ralf Schaefer, Rüssingen (DE)

(73) Assignee: PROACTOR SCHUTZRECHTSVERWALTUNGS GMBH, Rüssingen (DE)

( * ) Notice: Subject to any disclaimer, the term of this patent is extended or adjusted under 35 U.S.C. 154(b) by 0 days.

(21) Appl. No.: 13/984,811

(22) PCT Filed: Feb. 9, 2012

(86) PCT No.: PCT/EP2012/052226

§ 371 (c)(1),
(2), (4) Date: Sep. 12, 2013

(87) PCT Pub. No.: WO2012/107526

PCT Pub. Date: Aug. 16, 2012

(65) Prior Publication Data

US 2014/0008470 A1 Jan. 9, 2014

(30) Foreign Application Priority Data

Feb. 10, 2011 (DE) ..... 10 2011 010 980

(51) Int. Cl.
*B02C 13/288* (2006.01)
*B02C 13/14* (2006.01)
(Continued)

(52) U.S. Cl.
CPC ..... *B02C 13/288* (2013.01); *B02C 13/14* (2013.01); *B02C 13/284* (2013.01); *B02C 13/286* (2013.01); *B02C 23/24* (2013.01); *B02C 23/34* (2013.01); *B02C 23/00* (2013.01)

(58) Field of Classification Search
CPC .... B02C 19/18; B02C 19/186; B02C 13/288; B02C 13/284; B02C 13/286; B02C 23/00; B02C 23/24; B02C 23/34
USPC ..... 241/18, 23, 28
See application file for complete search history.

(56) References Cited

U.S. PATENT DOCUMENTS 4,324,612 A * 4/1982 Lindahl ..... 162/23
6,073,866 A 6/2000 Silver et al.

FOREIGN PATENT DOCUMENTS

CN 101272862 A 9/2008
CN 201171997 Y 12/2008
(Continued)

OTHER PUBLICATIONS

International Search Report dated Aug. 24, 2012 issued in connection with PCT/EP2012/052226, with English translation.
(Continued)

*Primary Examiner* — Faye Francis
(74) *Attorney, Agent, or Firm* — Foley & Lardner LLP

(57) ABSTRACT

A method for crushing and drying damp wood, wherein the wood is introduced into an impact reactor, which has a substantially cylindrical main body, in the closed interior space of which there rotates a rotor with at least one impact element, which contacts the wood and crushes it into part-constituents while generating a great transfer of momentum. The interior space of the cylindrical main body is assigned a suction removal device, which during the impact crushing removes the mist of moisture produced when the impact element makes contact with the material, and the interior space of the cylindrical main body has admitted to it hot gas, heated by waste heat from a combustion process, at a temperature of less than 95° C., in particular less than 80° C., or the exhaust gas from a combustion process, which after a collision of the impact element with a material constituent penetrates the material constituent in place of the moisture leaving. Also a device for carrying out the method.

12 Claims, 5 Drawing Sheets

(51) Int. Cl.

| | |
|---|---|
| ***B02C 13/284*** | (2006.01) |
| ***B02C 13/286*** | (2006.01) |
| ***B02C 23/34*** | (2006.01) |
| ***B02C 23/24*** | (2006.01) |
| *B02C 23/00* | (2006.01) |

(56) References Cited

FOREIGN PATENT DOCUMENTS

| | | |
|---|---|---|
| DE | 19852139 | 5/2000 |
| EP | 1057531 | 12/2000 |
| JP | H0924285 A | 1/1997 |
| WO | WO-97/18071 | 5/1997 |

OTHER PUBLICATIONS

Notice of the First Office Action and Search Report issued in co-pending Chinese Application No. 201280008425.6 dated Jul. 21, 2014, with English translation.

Notice of the Second Office Action issued in co-pending Chinese Application No. 201280008425.6 dated May 7, 2015, with English translation.

* cited by examiner

METHOD AND DEVICE FOR CRUSHING AND DRYING MOISTURE-CONTAINING MATERIAL, ESPECIALLY WOOD

CROSS REFERENCE TO RELATED APPLICATIONS

The present application is a U.S. National Stage of International Application No. PCT/EP2012/052226 filed on Feb. 9, 2012, which claims the benefit of German Patent Application No. 10 2011 010 980.3 filed on Feb. 10, 2011. The entire disclosures of which are incorporated herein by reference.

FIELD OF THE INVENTION

A method and apparatus for crushing and drying moisture-containing material, especially wood.

The invention relates to a method and an apparatus for crushing and drying moisture-containing material, especially moist wood.

BACKGROUND INFORMATION

It is known from the state of the art to dehumidify moist wood and similar biomasses such as grass or corn or even hygroscopic synthetic materials by means of drying devices such as drum dryers, belt dryers, entrained-flow dryers or chute dryers which are usually operated with primary energy inputs such as oil, gas, coal or even process heat. The material to be dried will not be subjected to any relevant mechanical stresses in these drying devices, which leads to the consequence that the material and cell structures will be in a relative idle state during the drying process, or will only move at a comparatively low speed. Due to the lack of mechanical stresses of the material to be dehumidified during the drying process, the fluids enclosed in the material such as especially the contained capillary water and the water that is chemically bound by way of OH groups in the cell material will be expelled from the material to be tried only as a consequence of the supplied thermal energy in such a way that the fluids within the material will convert into the gaseous state and will exit from the material as a result of the occurring vapor pressure.

This usually leads to the consequence that the water expelled from the cell structures by the vapor pressure will return to the cell structure when the water vapor emitted from the material to be dried is not immediately removed from the ambient environment of the material, e.g. a wood particle.

That is why the aforementioned drying apparatuses of the state of the art are relatively energy-consuming.

It is a further common aspect in the aforementioned drying apparatuses that they require input material which needs to have a grain size which is predetermined within narrow limits and which must not vary strongly. They further require a relatively strong gas stream in order to remove the expelled water or water vapor and to thereby prevent a reuptake of the expelled water by the material.

Finally, the drying devices as described above come with the disadvantage that the dwell time of material in the devices is comparatively long, which consequently leads to high energy consumption that is caused by the method.

It is further known from the state of the art to process components which are composed of different materials such as metal parts, glass, rubber, wood, polymers, fibre materials and composite materials by means of powder-coated or plastic-coated aluminium profiles in impact reactors in which the components are crushed by impact stresses by means of impact elements.

In this connection, a method and an apparatus are known from EP 0 859 693 B1 for the processing of components made of mixed materials, especially mixed synthetic materials, in which an impact reactor comprises in its cylindrical base body a rotor that is rotatable by a drive motor. The rotor which is adjustable in its height consists of wear-proof steel and comprises detachably accommodated impact elements at its ends, which impact elements will crush the introduced components into fragments of different size produced by the impact stresses occurring during the impact, which fragments can subsequently be separated from one another. The entire specification does not provide any indication of crushing and simultaneously drying moist wood or other biological material.

It is further known from EP 1 057 531 A1 to inject water into an impact reactor during the crushing of wood and to remove by suction the occurring water vapor on the upper side of the reactor. The specification does not provide any indication of introducing moist wood into the reactor and of drying said wood under simultaneous supply of hot gases with a temperature of less than 95° C., especially less than 80° C., or the exhaust gas from a combustion process into the impact chamber which penetrates the material instead of the expelled water during impact stresses of the material.

It is therefore an object of the present invention to provide a method and an apparatus with which wood can be crushed and dried simultaneously with low energy input.

SUMMARY

In accordance with the invention, the material is introduced into an impact reactor in a method for crushing and drying moisture-containing material, especially wood, which impact reactor has a substantially cylindrical main body, in the closed interior space of which there rotates a rotor with at least one impact element, which comes into contact with the wood and crushes it into part-constituents while generating a great transfer of momentum, said part-constituents being discharged from the interior space of the main body through a discharge opening which is arranged in the region of the circumferential area of the cylindrical main body and is especially covered by a screen. The method is characterized in that the interior space of the cylindrical main body is assigned a suction device which during the impact crushing removes the mist of moisture produced when the impact element makes contact with the material, and that the interior space of the cylindrical main body is supplied with a hot gas heated by waste heat from a combustion process, at a temperature of less than 95° C., especially less than 80° C., or with the exhaust gas from a combustion process which after a collision of the impact element with a material constituent penetrates the material constituent in place of the expelled humidity.

The impact dryer is based on the impact reactor described in the aforementioned EP 0 859 693 B1 and utilizes its basic mechanical properties.

Although the method in accordance with the invention and also the apparatus in accordance with the invention, which will be described below in closer detail, can principally be used for the simultaneously crushing and drying of any moisture-containing materials such as especially moist organic materials such as fuels for power plants, moist petroleum coke, moist oil sands, moist sewage sludge, moist lignin from wood processing, or even moist mineral waste (which means residues from the construction industry such as tar and plasterboard, etc), they are preferably used for crushing and drying moist wood and will therefore be described below on the basis of this process.

Insofar as reference is made in the description of the present application to moist material or moist wood, then this shall relate to a material whose moisture content, especially water content, is more than 30% by weight, preferably more than 40% by weight, respectively relating to the entire weight of the moist material.

The wood to be dried is introduced into the interior space of the impact reactor preferably in form of larger parts of wood with a diameter of 300 mm and a length of 500 mm for example, or even smaller, via a suitable conveying device such as a rotary feeder or a conveying screw or by hand, which impact reactor will also be referred to below as the impact chamber or impact space.

A rotor is arranged in the bottom region of the impact chamber which can have a diameter of 1 m to 3.5 m and which is driven for example by an internal combustion engine with a nominal power of 20 kW or more via a suitable transmission, or also by an electric motor with a speed of 750 rpm to 6000 rpm for example. When the impact elements accommodated on the rotor meet the wood parts which are preferably supplied from above via a gate operating with slides for example, the parts of wood are repeatedly subjected to very high accelerations and transfers of momentum, which leads to the consequence that the parts of wood are continuously deformed and will increasingly be crushed with progressing duration.

Once the wood particles have reached a specific size after a specific duration of 10 seconds for example, the cell structure of the wood particle will be made to vibrate up into the innermost depth of the same in the subsequent impact processes, by means of which the cell membranes will tear and split open and the moisture contained therein can easily be expelled. As was noticed by the applicant, the discharge of the moisture will be promoted in this case in such a way that the water situated in the cell structures will be accelerated more strongly than the remaining wood material since water has a higher density than wood. In other words, the water will be accelerated more strongly during an impact of the impact elements on the wood particles than the remaining wood material which forms the wood structure, which leads to the consequence that the water will be accelerated out of the split wood structures.

As was recognized by the applicant, the water is misted in this "water acceleration process" similar to an ultrasonic atomizer and leaves the wood structure under simultaneously high acceleration.

In order to accelerate the drying process of the initially moist wood and to reduce the energy input for this purpose as far as possible, the interior space of the impact reactor will be connected to a vacuum source which removes the released water mist by suction preferably on the upper side. At the same time or alternatively, the impact chamber will be supplied with a hot gas which encloses the wood particles and which will enter the split cell structures directly after the discharge of the water mist from said cell structures as a result of its density and mass which is low in comparison with the water mist, and it will prevent that the water mist will return to the cell structures. Since the water mist has a considerably lower temperature than the water vapor, which can lie in the range of 30 to 50° C. for example, it is therefore not necessary with the method in accordance with the invention to evaporate the water contained in the wood with a content of up to 55% under high input of energy in order to expel said water from the cell structures, as usually occurs in the drying of moist wood or biomass.

Ambient air with a temperature of less than 95° C., especially less than 80° C., and preferably a temperature in the range of between 40° C. and 65° C. is used as hot gas, which is obtained by means of a heat exchanger from the waste heat of a combustion process, e.g. the exhaust heat from a power plant, which as a result of the low temperature can no longer be used conventionally for direct production of energy, e.g. in a turbine. Alternatively, it is also possible to introduce the exhaust gas from a combustion process directly into the interior space of the impact reactor for the purpose of especially energy-efficient crushing and simultaneous drying, which will be described below in closer detail.

Once the crushed wood particles have remained for a predetermined period of time in the impact chamber or the desired degree of drying was reached, which can be determined for example by means of a suitable sensor system, the wood particles will be discharged from the impact chamber via one or several discharge openings on the circumference of the cylindrical main body.

The operation of the impact reactor (impact dryer) occurs in batches in the previously described, principal embodiment of the method in accordance with the invention, and without the object that at the end of the crushing and drying process a well-defined grain size of the wood particles is obtained.

In accordance with a further embodiment of the method in accordance with the invention in which the operation of the impact reactor preferably occurs continuously and the crushed and dried wood constituents have a desired defined grain size, the moist wood will be supplied to the impact reactor in a continuous manner or also in batches preferably from above and—as already described above—will be crushed and dried by means of the impact elements under the influences as explained above for such a time until it has reached a grain size which is slightly smaller than the opening diameter of one or several of the screens arranged on the outside wall of the impact reactor.

The wood particles which are dried completely or even partly will now leave the impact chamber through the screens and will fly at high speed into an ejection box which is arranged on the outside of the cylindrical main body and which is preferably arranged on said main body together with a further ejection box on the side of the impact chamber which is diametrically opposite of the ejection box.

In the preferred embodiment of the invention, the ejection boxes comprise discharge screw conveyors in their bottom level, which are respectively guided in a tube which extends in continuation outside of the respective ejection box from the housing of the ejection box and is circumferentially enclosed in this region.

The screw spiral of the discharge screw conveyors, which can be driven electrically or also mechanically via a gear and an internal combustion engine such as the internal combustion engine of a tractor, has a narrower cut in the circumferentially enclosed region of the tube, i.e. it has a lower lead, so that the material to be discharged (i.e. the crushed and dried wood particles) are compressed in this region before they are discharged from the free end of the tube into a suitable collecting container. This advantageously provides mechanically simple and cost-effective sealing of the interior space of the ejection boxes or the impact chamber against the ambient environment without requiring complex seals or other measures. If desired, it can also be provided to arrange rotary feeders at the end of the discharge screw conveyors in order to improve sealing.

In accordance with a further idea on which the invention is based, hot gas or hot inert gas is allowed to flow preferably laterally and/or from below through the ejection boxes, which hot gas prevents moisture absorption by the wood particles and absorbs the wood moisture. The hot gas, which is also preferably the exhaust gas purified via an exhaust purification system or the non-purified exhaust gas of an internal combustion engine which especially drives the rotor and the discharge screw conveyors and optionally also the conveying device for supplying the wood pieces to be dried, will then enter the ambient environment preferably laterally or in the upper region of the ejection boxes and/or will be removed there by suction.

In accordance with a further idea on which the invention is based, it can be provided that the hot gas will be recirculated within the interior space of the main body. This leads to the advantage that the dwell time and therefore the exposure time of the hot gas within the impact chamber or within the ejection boxes is increased by several times in comparison with direct introduction of the gas into the bottom part of the impact chamber and the discharge of the same in the upper region of the impact chamber or the ejection boxes.

In a further embodiment of the invention, the temperature of the wood will advantageously be increased prior to the introduction into the main body, especially up to a temperature of more than 80° C., for which purpose the wood is stored first in a heated, water-filled container which is heated especially by the exhaust heat of an internal combustion engine or also by other process heat or waste heat.

As was established by the applicant, the strength of the binding constituents in moist wood will be reduced substantially by the introduction of the wood into a container filled with heated water, which already at comparatively low temperatures of approximately 40° C. lead to a considerable reduction in the energy demand required for the mechanical crushing process in the impact reactor. The further effect is advantageously utilized that wood is capable of absorbing humidity only up to approximately 55% of its own weight, which leads to the consequence that as a result of the watering of the wood in accordance with the invention in a heated water bath the moisture content will be increased only slightly, whereas the strength will decrease considerably in comparison thereto.

It is especially advantageous when the thermal energy for heating the container filled with water is also provided by waste heat, e.g. the residual thermal energy in cooling water of the internal combustion engine which also drives the rotor mechanically, because an especially efficient utilization of the fuel for operating a motor will be provided in this manner.

In accordance with a further idea of the latter embodiment of the invention, the wood in the container can also be heated under pressure to a temperature of more than 100° C., wherein the maximum achieved temperature is preferably less than 180° C. The water bath can be supplied with a dye or a salt if desired in order to obtain colored or salt-laden dry wood particles as a finished product, wherein the latter can be used as a substitute for de-icing salt for example and can be provided with the advantage that it will simultaneously increase both the level of slip protection and bind the salt for a longer period of time and release the same when required than would be the case with pure salt grains.

It can further be provided that the crushed wood constituents which are discharged from the interior space of the cylindrical main body and which will also be referred to below as wood particles will be subsequently dried in a press roller nip under supply of blast air if a degree of drying is desired which cannot be achieved by using the aforementioned method in accordance with the invention, even when recirculating the exhaust gas within the impact chamber and/or the ejection boxes.

BRIEF DESCRIPTION OF THE DRAWINGS

The invention will be described below by reference to the drawings on the basis of preferred embodiments of the apparatus in accordance with the invention for performing the method, wherein the drawings show as follows.

DETAILED DESCRIPTION

Figure 1:
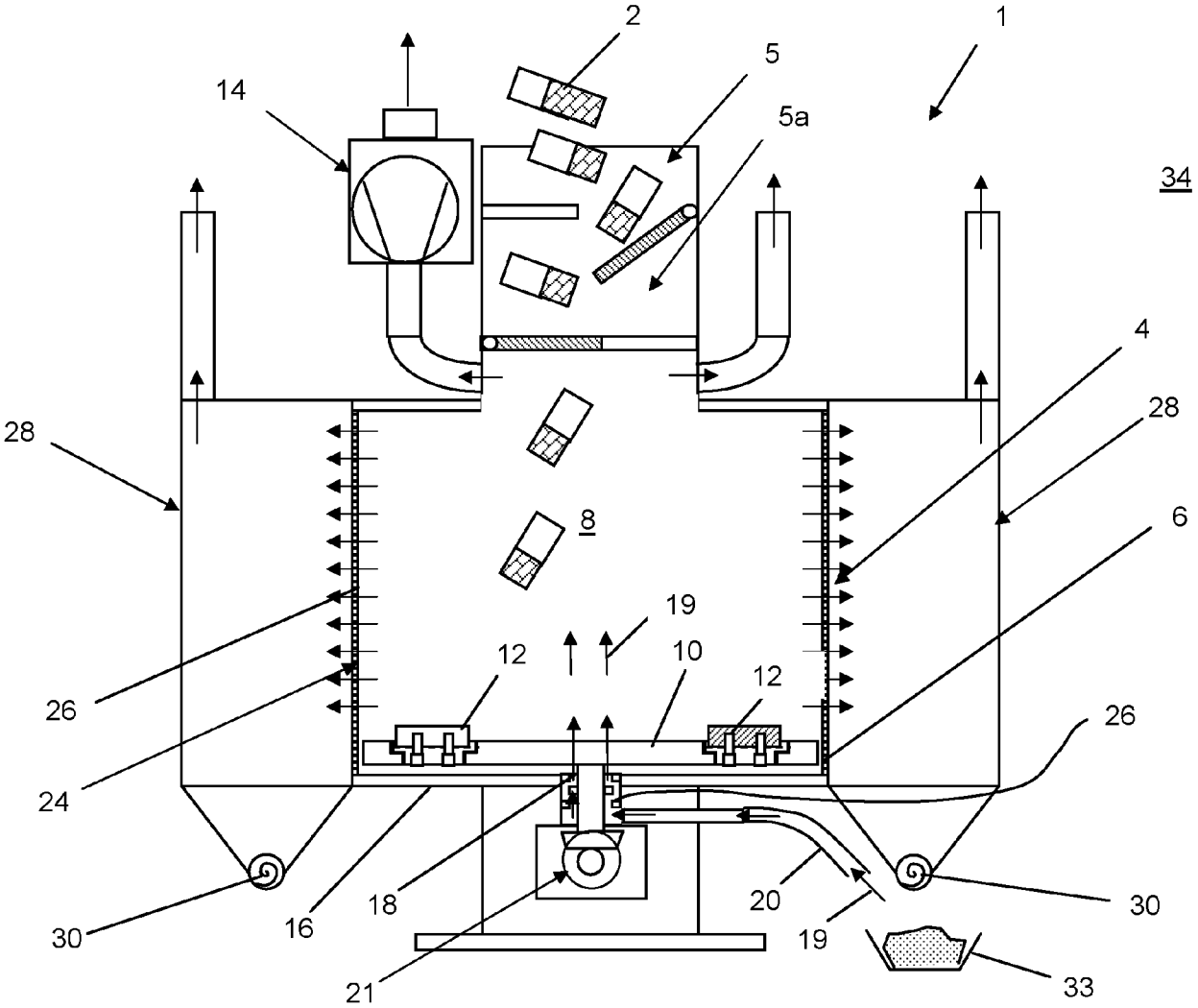
FIG. 1 shows a schematic cross-sectional view of an apparatus in accordance with the invention for crushing and drying wood.
Figure 3:
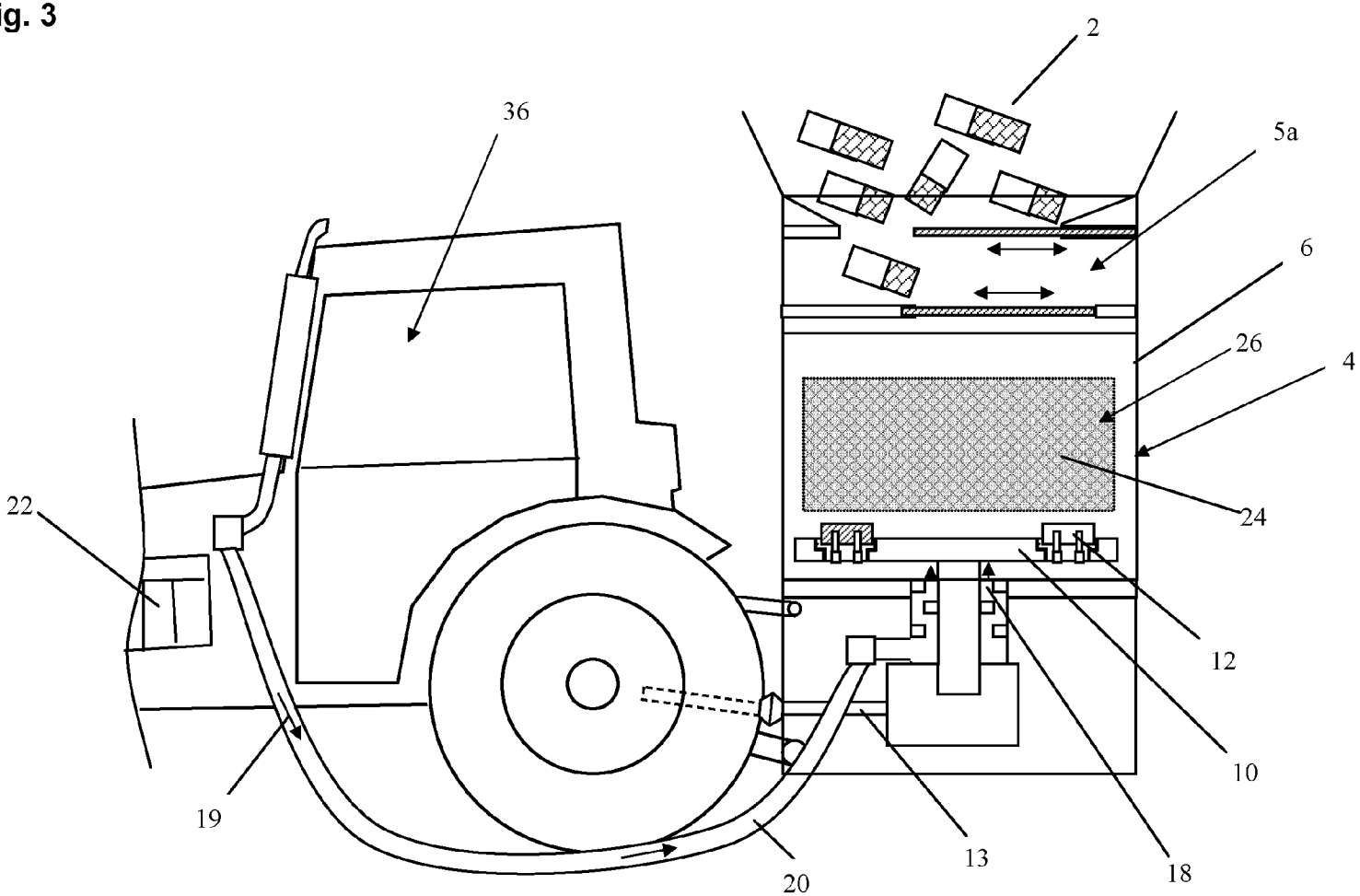
FIG. 3 shows a schematic view of a tractor with an apparatus in accordance with the invention which is accommodated thereon and in which the exhaust gas of the internal combustion engine is introduced into the impact chamber via an exhaust gas feed line in the bottom region of the impact reactor.
Figure 4:
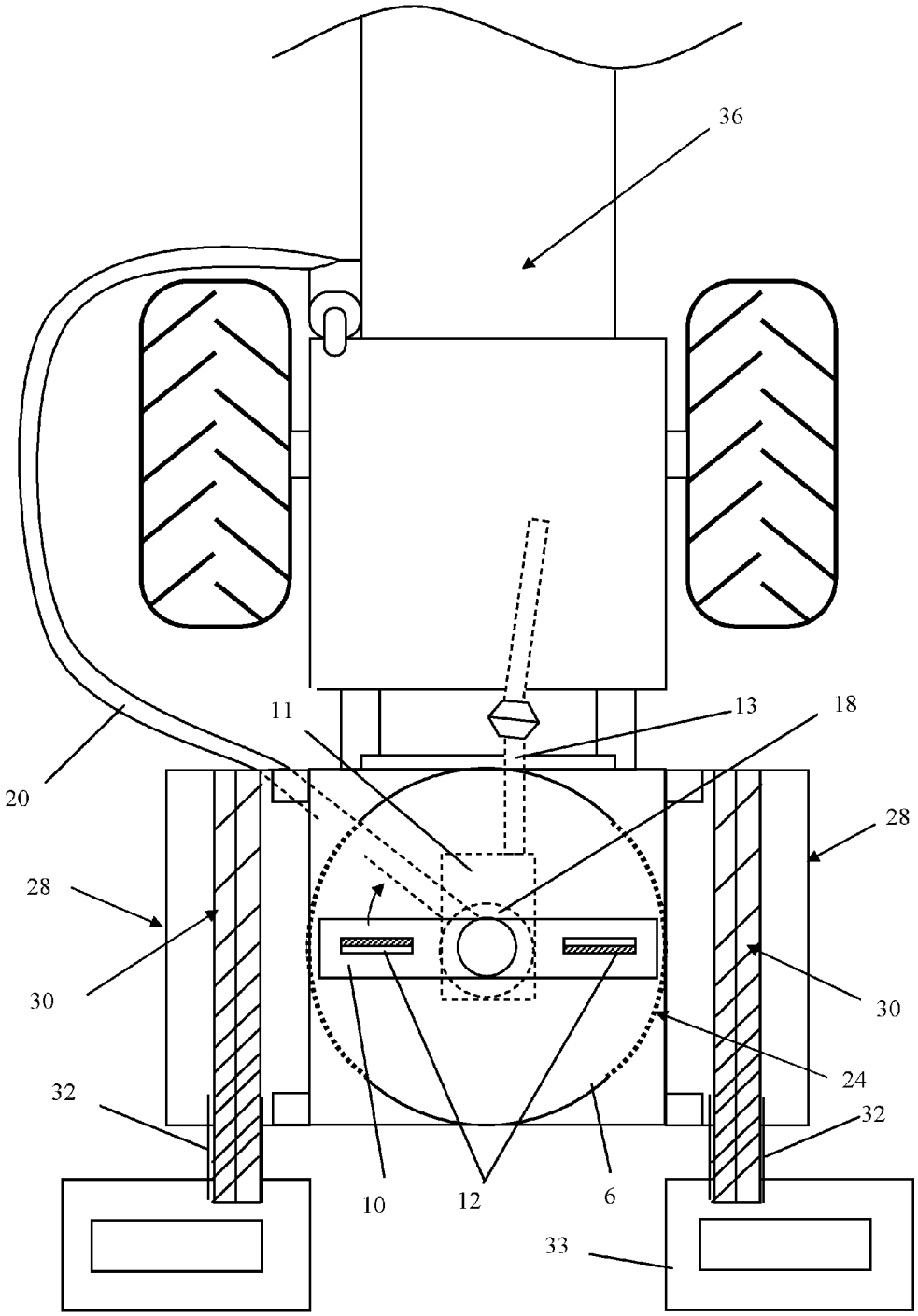
FIG. 4 shows a top view of the tractor and the apparatus of FIG. 3.

As is shown in FIG. 1, an apparatus 1 in accordance with the invention for crushing and drying moist material, which is present in the form of wood pieces 2 for example, comprises an impact reactor 4 having a substantially cylindrical main body 6, in the enclosed interior space 8 of which a rotor 10 rotates at high speed, on which several preferably exchangeable impact elements 12 are arranged which are made of a high-strength material. The drive of the rotor 10 occurs via an angular gear 11 and a power take-off shaft 13 (shown in FIG. 3 for example) by the internal combustion engine 22 of an agricultural or forestry vehicle 36, on which the apparatus 1 in accordance with the invention can be accommodated in the manner as shown in FIG. 3 and FIG. 4.

Figure 2:
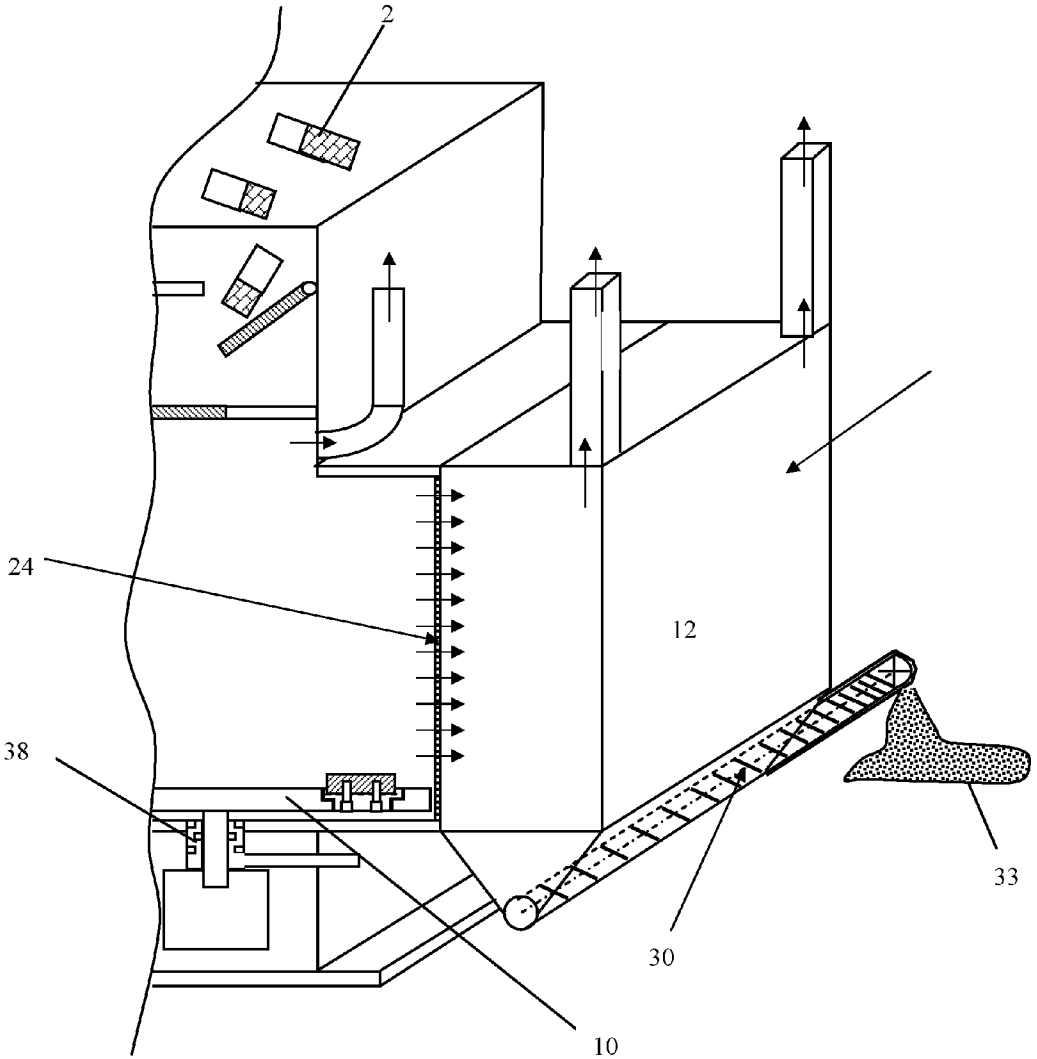
FIG. 2 shows a schematic spatial side view of one of the ejection boxes of the apparatus shown in FIG. 1.

As is further shown in the illustration of FIGS. 1 and 2, a gate 5 with a gate chamber 5*a* which can be closed by means of a slide or flaps is arranged on the upper side of the cylindrical main body 6, via which the pieces of wood 2 can be introduced from above into the interior space 8 of the impact reactor 4 without having to provide free access between the ambient environment 34 and the interior space 8 of the impact reactor 4. The gate 5 is only shown by way of example in the drawings and can also be a rotary feeder with a rotary feeder axis extending horizontally or vertically, which supplies the coarsely crushed moisture containing material from above to the interior space 8 of the impact reactor 4. In order to reduce the introduction of ambient air together with the material to the highest possible extent, a removal of air by suction can be provided directly before the entrance of the material 2 into the interior space 8. For this purpose, the gate chamber will be sealed for a predetermined period of time in an air-tight manner in the case of the illustrated gate 5, and in the case of the rotary feeder (not shown) preferably the gate chamber in which the material is situated directly before the entrance into the interior space 8, and will be supplied with a negative pressure. It is also possible to supply the moist material by means of a rotating conveying screw which opens directly into the otherwise sealed interior space 8, which is especially advantageous in the case of a continuous supply of material.

As is shown in FIGS. 1 to 4, two ejection boxes 28 are preferably arranged on the outside of the cylindrical base body 6, which ejection boxes are respectively in connection with the interior space 8 of the impact reactor 4 via an ejection opening 26 which is partly closed off by a screen 24.

A discharge screw conveyor 30 is arranged in the bottom region of each ejection box 28, which screw conveyor is driven by a motor or a gear branch-off of the angular gear 11 and has a lead of the screw spiral which decreases as seen in the conveying direction of the screw conveyor. The discharge screw conveyor 30 extends at least partly in a discharge tube 32 which is circumferential enclosed in the region outside of the ejection box and extends above a collecting container 33, in which the crushed and also dried material 2*a* is collected which is discharged from the ejection boxes 28.

In accordance with the illustration of FIGS. 1 and 2, the interior space 8 of the cylindrical main body is connected via a feed line 20 to a hot-gas source, which is preferably the internal combustion engine 22 of the forestry vehicle 36 indicated in FIG. 2. The hot gas 19, i.e. the hot diesel exhaust gas which is usually purified by a respective exhaust gas purification system, will be branched off by a branch-off point (not shown) from the exhaust gas system of the internal combustion engine 22 and will be introduced via the hot-gas feed line 20 into the bottom region of the impact reactor 4. It will be introduced from there preferably via a feed opening in the region of the drive shaft of the rotor 10 via a labyrinth seal 38 indicated in FIGS. 1 and 3. In the interior space 8 of the impact reactor 4, the hot gas 19, which has a temperature of less than 95° C. for example, meets the wood constituents 2*a* situated in the interior space 8 during the impact process, with the hot gas penetrating said constituents after the water contained in the wood constituents was expelled from the wood constituents as a result of the high transfer of momentum and the resulting high acceleration during an impact process.

Alternatively or preferably simultaneously, the interior space 8 of the main body 6 will be subjected to negative pressure via a suction apparatus 14, so that the liquid mist produced by the large number of impact processes during the crushing of the wood 2 will be removed by suction from the interior space 8.

In order to increase the dwell time of the exhaust gas 19 within the impact chamber 8 it can be provided that the exhaust gas 19 is removed by suction via the suction apparatus 14 on the upper side of the impact reactor 4 together with the liquid mist. The liquid contained in the aspirated gas can be removed from the exhaust gas via a liquid separator if desired, and the exhaust gas can be introduced back to the bottom region of the impact reactor 4 via a mixing valve (not shown in the drawings in closer detail). It is understood that there is a possibility of recirculating only a partial stream of the exhaust gas via respective valves and to discharge a further partial stream together with the liquid mist via the suction apparatus 14.

The supply of the recirculated hot gas 19 can also occur in the region of the bottom side of the ejection boxes 28 or in the region of the discharge screw conveyors 30, which leads to the advantage that the already dried wood constituents 2*a* which were crushed by the impact process in the impact chamber 8 up to a size in the region of the opening size of the screens 24 are directly subjected to dried hot gas again after the exit from the screens 24 into the ejection boxes 28, which advantageously further reduces the residual moisture.

In order to further reduced the residual moisture of the dried wood particles 2*a*, which can have a grain size in the range of 0.1 to 5 mm, it can be provided that they are supplied to a roller nip 40 of two press rollers 40*a* and 40*b* (indicated in FIG. 5), which will squash the wood particles 2*a* and will thereby press out the remaining moisture from the interior of the wood particles. In order to remove the pressed-out residual moisture from the wood particles 2*a* that are pressed flat in the roller nip 40, the roller nip will be subjected to blast air 42 which can be directed transversally to the falling direction of the wood particles 2*a* which exit from the roller nip 40, or also in the direction towards the roller nip 40.

Figure 5:
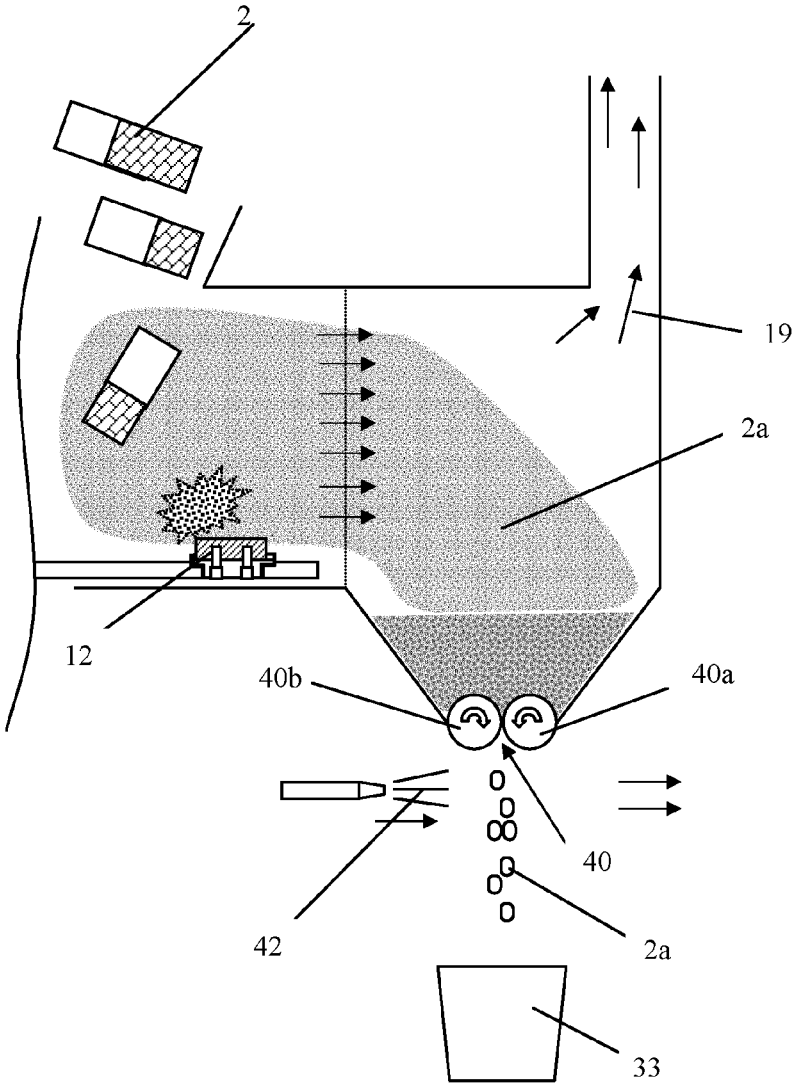
FIG. 5 shows a schematic partial view of a further embodiment of the apparatus in accordance with the invention, in which a press roller nip which is supplied with blast air is provided in the region of the bottom of the ejection box, through which the crushed and pre-dried wood particles are pressed for subsequent drying.

The use of a press roller nip 40 in conjunction with blast air 42 for drying the wood particles 2*a* is not limited to the arrangement in the bottom region of one of the ejection boxes 28 as shown in FIG. 5, but can also occur separate from the actual impact reactor 4 when the wood particles 2*a* are crushed only coarsely without simultaneously drying the same by the hot gas 19. The coarsely crushed wood particles are supplied directly to the roller nip 40 in this case.

LIST OF REFERENCE NUMERALS

1 Apparatus in accordance with the invention
2 Wood
2*a* Crushed part-constituents of the wood/wood particle
4 Impact reactor
5 Gate
5*a* Gate chamber
6 Main body
8 Interior space/impact chamber
10 Rotor
12 Impact elements
13 Power take-off shaft
14 Suction device
16 Bottom of cylindrical main body
18 Feed opening for hot gas
19 Hot gas/exhaust gas
20 Hot gas feed line
21 Angular gear
22 Internal combustion engine
24 Screen
26 Ejection opening
28 Ejection box
30 Discharge screw conveyor
32 Discharge tube
33 Collecting container
34 External ambient environment
36 Tractor
38 Labyrinth seal
40 Roller nip
40*a* Press roller
40*b* Press roller
42 Blast air

The invention claimed is:

1. A method for crushing and drying moisture-containing material, the method comprising:

introducing moisture-containing material into an impact reactor comprising a substantially cylindrical main body coupled to a suction device, a closed interior space of the cylindrical main body containing a rotor having at least one impact element;

impact crushing the moisture-containing material by contacting the moisture-containing material with the at least one impact element and crushing the material into part-constituents while generating a great transfer of momentum;

removing, during the impact crushing, a mist of moisture expelled from the moisture-containing material when the at least one impact element contacts the moisture-containing material with the suction device; and supplying the interior space of the cylindrical main body with hot gas having a temperature of less than 95° C., the hot gas being heated by at least one of waste heat from a combustion process, and exhaust gas from the combustion process, wherein the hot gas penetrates the part-constituents and replaces the mist of moisture removed by the suction device.

2. The method according to claim 1, further comprising discharging the part-constituents from the interior space of the cylindrical main body through a discharge opening which is arranged in a region of a circumferential area of the cylindrical main body that is covered by a screen.

3. The method according to claim 1, wherein the hot gas comprises purified exhaust gas of a diesel engine which drives the rotor.

4. The method according to claim 1, wherein the hot gas comprises dried ambient air which is heated by the waste heat of the combustion process or an internal combustion engine using a heat exchanger.

5. The method according to claim 1, further comprising recycling the hot gas within the interior space of the cylindrical main body.

6. The method according to claim 1, further comprising increasing a temperature of the moisture-containing material to 80° C. or greater, prior to introducing the moisture-containing material into the main cylindrical body.

7. The method according to claim 6, wherein the moisture-containing material is heated using a container filled with water and one of waste heat or by process heat of an internal combustion engine.

8. The method according to claim 7, wherein the moisture-containing material is heated under pressure in the container to a temperature of more than 100° C. and less than 180° C.

9. The method according to claim 2, wherein the part-constituents that are discharged from the interior space of the cylindrical main body are subsequently dried in a press roller nip under a supply of blast air.

10. The method according to claim 1, wherein the moisture-containing material comprises moist wood.

11. The method according to claim 1, wherein the moisture-containing material has a moisture content greater than 30% by weight with respect to an entire weight of the moisture-containing material.

12. The method according to claim 1, wherein the temperature of the hot gas supplied to the interior space of the cylindrical main body is in a range between 40° C. and 65° C.

* * * * *